US009410462B2

(12) United States Patent
Nilsson

(10) Patent No.: US 9,410,462 B2
(45) Date of Patent: Aug. 9, 2016

(54) CHANNEL SYSTEM

(76) Inventor: Sven Melker Nilsson, Kållered (SE)

( * ) Notice: Subject to any disclaimer, the term of this patent is extended or adjusted under 35 U.S.C. 154(b) by 0 days.

(21) Appl. No.: 12/737,505

(22) PCT Filed: Jul. 8, 2009

(86) PCT No.: PCT/SE2009/050880

§ 371 (c)(1),
(2), (4) Date: Jan. 20, 2011

(87) PCT Pub. No.: WO2010/016792

PCT Pub. Date: Feb. 11, 2010

(65) Prior Publication Data

US 2011/0120687 A1 May 26, 2011
US 2012/0279693 A2 Nov. 8, 2012

(30) Foreign Application Priority Data

Aug. 6, 2008 (SE) ..... 0801767

(51) Int. Cl.
*F28D 7/02* (2006.01)
*F28F 1/10* (2006.01)
(Continued)

(52) U.S. Cl.
CPC ..... *F01N 3/2821* (2013.01); *F28D 9/0062* (2013.01); *F28F 3/025* (2013.01); *F28F 13/06* (2013.01); *F28F 13/12* (2013.01)

(58) Field of Classification Search
USPC ..... 165/164, 172, 179, 155, 154, 146, 147; 60/298, 299; 122/424, 426
See application file for complete search history.

(56) References Cited

U.S. PATENT DOCUMENTS 2,006,649 A * 7/1935 Modine ..... 165/146
2,011,756 A * 8/1935 Diamant ..... 165/146
(Continued)

FOREIGN PATENT DOCUMENTS

CN 2296989 Y 11/1998
CN 1204972 1/1999
(Continued)

OTHER PUBLICATIONS

Office Action dated Mar. 22, 2012 issued in corresponding Chinese Application No. 200980130105.6 and English translation thereof.
(Continued)

*Primary Examiner* — Allen Flanigan
*Assistant Examiner* — Jason Thompson
(74) *Attorney, Agent, or Firm* — Harness, Dickey & Pierce, P.L.C.

(57) ABSTRACT

Present invention relates to a channel system for improving the relation between pressure drop and heat, moisture and/or mass transfer of fluids flowing through said system, said channel system comprising at least one channel comprising at least a first and a second flow director, said channel having a cross-section area A and a first and a second cross-section area $A_1$, $A_2$ at respective flow director, said flow directors extending in a fluid flow direction and transversely to said channel, and comprising an upstream portion, deviating, in said fluid flow direction, from a channel wall of said channel inwardly into said channel, a downstream portion returning, in said fluid flow direction, towards said channel wall, and an intermediate portion located between said upstream and downstream portions, wherein said first cross-section area $A_1$ at said first flow director is smaller than said second cross-section area $A_2$ at said second flow director.

33 Claims, 7 Drawing Sheets

(51) Int. Cl.

| | |
|---|---|
| ***F28F 1/42*** | (2006.01) |
| ***G05D 23/00*** | (2006.01) |
| ***F01N 3/28*** | (2006.01) |
| ***F28D 9/00*** | (2006.01) |
| ***F28F 3/02*** | (2006.01) |
| ***F28F 13/06*** | (2006.01) |
| ***F28F 13/12*** | (2006.01) |

(56) References Cited

U.S. PATENT DOCUMENTS

| | | | | |
|---|---|---|---|---|
| 3,151,675 | A | 10/1964 | Lysholm | |
| 4,152,302 | A | 5/1979 | Nonnenmann et al. | |
| 4,230,179 | A * | 10/1980 | Uehara et al. | 165/113 |
| 4,314,587 | A * | 2/1982 | Hackett | 138/38 |
| 4,809,415 | A * | 3/1989 | Okayama et al. | 29/890.048 |
| 5,157,010 | A | 10/1992 | Maus et al. | |
| 5,177,960 | A * | 1/1993 | Hitachi et al. | 60/299 |
| 5,309,637 | A * | 5/1994 | Moriarty | 29/890.054 |
| 6,187,274 | B1 * | 2/2001 | Nilsson | 422/180 |
| 6,422,306 | B1 * | 7/2002 | Tomlinson et al. | 165/170 |
| 6,972,009 | B1 | 12/2005 | Stromberg et al. | |
| 7,096,933 | B1 | 8/2006 | Zia et al. | |
| 2002/0040777 | A1 | 4/2002 | Tomlinson et al. | |
| 2007/0125528 | A1 * | 6/2007 | Fakheri | 165/163 |

FOREIGN PATENT DOCUMENTS

| | | | |
|---|---|---|---|
| CN | 1432123 | | 7/2003 |
| DE | 3744265 | A1 | 7/1989 |
| EP | 0298943 | A2 | 1/1989 |
| EP | 0869844 | A1 | 10/1998 |
| EP | 2472210 | A1 | 7/2012 |
| GB | 2207232 | A | 1/1989 |
| JP | 6021890 | U | 2/1985 |
| JP | 2002-048491 | A | 2/2002 |
| JP | 2004-503739 | A | 2/2004 |
| SE | 461 018 | B | 12/1989 |
| SE | 515132 | C2 | 6/2001 |
| SU | 591684 | A2 | 2/1978 |
| SU | 1462076 | A1 | 2/1989 |
| WO | WO 97/21489 | | 6/1997 |
| WO | WO 0196803 | A1 * | 12/2001 |
| WO | WO-0196803 | A1 | 12/2001 |
| WO | WO 2007078240 | A1 * | 7/2007 |
| WO | WO-2007078240 | A1 | 7/2007 |
| WO | WO-2009128750 | A1 | 10/2009 |

OTHER PUBLICATIONS

Written Opinion dated Nov. 3, 2009 issued in International Application No. PCT/SE2009/050880.

International Search Report dated Nov. 3, 2009 issued in International Application No. PCT/SE2009/050880.

European Search Report for corresponding European Application No. 09805232.7 dated Mar. 14, 2013.

English language translation of Chinese Office Action for corresponding Chinese Application No. 200980130105.6 dated Mar. 11, 2013.

European Search Report for corresponding European Application No. 08741856 dated Nov. 5, 2013.

International Search Report (PCT/ISA/210) dated Dec. 23, 2008 for International Application No. PCT/SE2008/000282.

International-Type Search Report (PCT/ISA/201/SE) dated Feb. 5, 2009 for International Application No. SE 0801767-5.

Chinese Office Action dated Aug. 24, 2011 for corresponding Chinese Application No. 200880128696.9.

English Summary of Russian Office Action dated Apr. 2, 2012 for corresponding Russian Application No. 2010146941.

English translation of Decision of Grant dated Jun. 28, 2012 for corresponding Russian Application No. 2010146941/06(067801).

English translation of Japanese Office Action dated Sep. 10, 2012 for corresponding Japanese Application No. 2011-504954.

English translation of Chinese Office Action dated Feb. 8, 2014 for corresponding Chinese Application No. 201210472701.6.

English translation of Chinese Office Action dated Jan. 22, 2014 for corresponding Chinese Application No. 201210473658.5.

English translation of Chinese Office Action dated Feb. 8, 2014 for corresponding Chinese Application No. 201210473338.X.

Korean Office Action dated Mar. 19, 2014 for corresponding Korean Application No. 10-2010-7025509.

English translation of Chinese Office Action dated Sep. 4, 2014 for corresponding Chinese Application No. 201210473658.5.

English translation of Chinese Office Action dated Sep. 16, 2014 for corresponding Chinese Application No. 201210473338.X.

English translation of pp. 75-78 of reference book "Transmission Principle," edited by Zesheng Ji et al., published by Harbin Institute of Technology Press, Dec. 2002.

U.S. Office Action dated Oct. 24, 2014 for copending U.S. Appl. No. 12/736,481.

U.S. Office Action dated May 22, 2015 for corresponding U.S. Appl. No. 12/736,481.

European Office Action dated Jan. 20, 2016 for EP Application No. 08741856.2 which corresponds to co-pending U.S. Appl. No. 12/736,481.

U.S. Office Action dated Dec. 17, 2015 for corresponding U.S. Appl. No. 12/736,481.

Office Action dated Nov. 14, 2012 issued in corresponding Chinese Application No. 200980130105.6 and English translation thereof.

English translation of Japanese Office Action dated Jan. 13. 2015 for corresponding JP Application No. 2013-220603.

English translation of Korean Office Action Summary dated Jan. 27, 2015 for corresponding KR Application No. 10-2014-7013357.

European Office Action dated Jun. 16, 2016 issued in European Application No. 08741856.2.

* cited by examiner

CHANNEL SYSTEM

FIELD OF THE INVENTION

The present invention relates to a channel system for improving the relation between pressure drop and heat, moisture and/or mass transfer of fluids flowing through the system, said channel system comprising at least one channel comprising at least a first and a second flow director, said channel having a cross-section area and a first and a second cross-section area at respective flow director, said flow directors extending in a fluid flow direction and transversely to said channel, and comprising an upstream portion, deviating, in said fluid flow direction, from a channel wall of said channel inwardly into said channel, a downstream portion returning, in said fluid flow direction, towards said channel wall, and an intermediate portion located between said upstream and downstream portions.

BACKGROUND ART

Heat exchangers/catalysts are often a channel system having a body, which is formed with a large number of juxtaposed small channels through which flows a fluid or fluid mixture, which, for example, is to be converted. The channel systems are made of different materials, such as ceramic materials or metals, for example stainless steel or aluminium.

Channel systems made of ceramic materials has a channel cross-section, which usually is rectangular or polygonal, for example hexagonal. The channel system is made by extrusion, which means that the cross-section of the channels is the same along the entire length of the channel, and the channel walls will be smooth and even.

In the manufacture of channel bodies of metals, a corrugated strip and a flat strip are usually wound around an axle or a spool. This results in channel cross-sections, which are triangular or trapezoidal. Most channel systems of metals that are available on the market have channels of the same cross-section along their entire length and have, like ceramic channel bodies, smooth and even channel walls. Both these types may be coated with a coating, for example in a catalyst with a catalytically active material.

What is most important in the context is the heat, moisture and/or mass transfer between the fluid or the fluid mixture flowing through the channels and the channel walls in the channel system.

In channel systems of the above type, used with for example internal combustion engines in vehicles or in the industry, with relatively small cross-sections of the channels and fluid velocities commonly used in these contexts, the fluid flows in relatively regular layers along the channels. The flow is thus essentially laminar. Only along a short distance at the inlet of the channels, a certain flow occurs transversely to the channel walls.

As is generally known in the art, a boundary layer is formed in laminar fluid flow next to the channel walls, where the velocity is essentially zero. This boundary layer significantly reduces the mass transfer coefficient, above all in the case of what is referred as fully developed flow, in which the heat, moisture and/or mass transfer occurs mainly by diffusion, which is relatively slow. The mass transfer coefficient is a measure of the mass transfer rate and should be great so as to obtain high efficiency of the heat exchange and/or the catalytic conversion. To increase the mass transfer coefficient, the fluid must be made to flow toward the surface of the channel side so that the boundary layers are reduced and the flow transfer from one layer to another is increased. This may take place by what is referred to as turbulent flow. Due to the low velocities in the channels, it is therefore desirable to create turbulence by artificial means, such as by arranging special flow directors in the channels.

U.S. Pat. No. 4,152,302 discloses a catalyst with channels, in which flow directors are arranged in the form of transverse metal flaps punched from the strip. A catalyst with flow directors significantly increases the heat, moisture and/or mass transfer. However, at the same time also the pressure drop increases dramatically. The effects of the pressure drop increase have, however, been found to be greater than the effects of the increased heat, moisture and/or mass transfer.

EP0869844 discloses turbulence generators extending transversely to the channels of a catalyst or heat/moisture exchanger to obtain an improved ratio of pressure drop to heat, moisture and/or mass transfer.

Within this technical field, manufacturers seek for possibilities to produce more cost efficient systems, which at the same time further improve the ratio of pressure drop to heat, moisture and/or mass transfer. Especially, a decreased pressure drop with maintained or improved heat, moisture and/or mass transfer is advantageous, since this results in a more efficient system and a lower required power input.

SUMMARY OF INVENTION

The object of the present invention is to provide a channel system having an improved ratio of pressure drop to heat, moisture and/or mass transfer.

The above object is achieved with a channel system, which has the features defined in appended claims.

A channel system according to the present invention for improving the relation between pressure drop and heat, moisture and/or mass transfer of fluids flowing through the system comprises at least one channel comprising at least a first and a second flow director. The channel has a cross-section area and a first and a second cross-section area at respective flow director, which flow directors extend in a fluid flow direction and transversely to the channel, and comprises an upstream portion, deviating, in the fluid flow direction, from a channel wall of the channel inwardly into the channel, a downstream portion returning, in the fluid flow direction, towards the channel wall, and an intermediate portion located between the upstream and downstream portions, wherein the first cross-section area at the first flow director is smaller than the second cross-section area at the second flow director. By varying the cross-section area at the flow directors the pressure drop and the conversion at each flow director may be affected. A larger cross-section area gives lower pressure drop and lower conversion, which makes it possible to improve the relation between total conversion and total pressure drop of the whole channel.

Preferably, the first and second cross-section areas are located at respective intermediate portions of the first and second flow directors.

Suitably, the first flow director is located, in a fluid flow direction, upstream of the second flow director. With upstream is meant that the first flow director is arranged, in the fluid flow direction, prior to the second flow director. In this way an unnecessary pressure drop at the second flow director is avoided. Since a major part of the fluid is converted at a first flow director which is, in fluid flow direction, upstream of a second flow director, the cross-section area at the second flow director may be, within certain limits, considerably larger than the cross-section area at the first flow director without substantially reducing the total conversion of the channel system. Hence, the total pressure drop of the channel may be reduced without significant drawbacks, and the ratio of the total pressure drop to the total conversion may be improved.

In a preferred embodiment, the first flow director is arranged closest to the inlet of the channel in relation to the second flow director. By having a first smaller cross-section area at the flow director near the inlet the conversion is improved compared with equal cross section areas at the flow directors, since a major part of the fluid is converted, in a fluid flow direction, at the first flow director after the inlet.

Advantageously, the first and second flow directors are directly subsequent in said fluid flow direction. Here, directly subsequent means that there is no additional fluid flow directors between the first and second flow director, but that there may be a distance between the first and second flow director. Such directly subsequent flow directors affect the relation between the pressure drop and conversion as desired, in a portion of the channel.

Preferably, the ratio of said second cross-section area $A_2$ at a flow director directly subsequent to the first flow director, which is arranged closest to the inlet, to said first cross-section area $A_1$, that is $A_2/A_1$, is 1.2-2.5, and more preferably 1.2-2.0. Suitably, the ratio of said second cross-section area $A_2$ at a flow director directly subsequent to the first flow director, which is arranged upstream of the second flow director, to said first cross-section area $A_1$, that is $A_2/A_1$, is 1.2-2.5, and more preferably 1.2-2.0. In this way the relation between total conversion and total pressure drop of the whole channel is still further increased. By having a first smaller cross-section area at the flow director near the inlet the conversion rate is improved compared with equal cross section areas at the flow directors, due to that a major part of the fluid is converted, in a fluid flow direction, at the first flow director after the inlet. Also, the larger cross-section at the second adjacent flow director decreases the pressure drop.

In a preferred embodiment, the ratio of the second cross-section area $A_2$ at the second flow director, located closest to the outlet of the channel, to said first cross-section area $A_1$ at the first flow director, located closest to the inlet of the channel, that is $A_2/A_1$, is 2.0-4.0. In this way the total pressure drop in the channel is further decreased without substantially affecting the conversion. This depends on both that a larger cross-section area decreases the local pressure drop, and that since a major part of the fluid is already converted, in a fluid flow direction, upstream of the flow director located nearest the outlet, the larger cross-section area do not substantially decrease the total conversion.

Suitably, the channel comprises at least one additional third flow director at which the channel has a third cross-section area. The third cross-section area may be equal to the first or second cross-section areas, respectively or different from the first and second cross-section areas. This, in order to further improve the relation between the pressure drop and conversion.

The channel may further comprise at least one additional third flow director arranged, in relation to a fluid flow direction, between the first and the second flow director. A third flow director further increases the heat, moisture and/or mass transfer of fluids flowing through the system.

In a preferred embodiment, the width of said cross-section of said channel is decreasing in one direction in the plane of said cross-section. That is, the cross-section of the channel may be triangular, trapezoidal, or having other top-shape, or the other way around so that the top may be disposed downwards. Preferably, the cross-section of said channel is preferably triangular. Such a shape is preferable from a viewpoint of manufacture. Especially, an equilateral triangular cross-section minimises the friction losses along the channel walls resulting in further decreased pressure drop compared with for example a quadratic cross-section.

Preferably, the ratio of the cross-section area of the channel to the first cross-section area at the first flow director, which is arranged closest to the inlet, is greater than 2.0, and preferably greater than 3.0, and more preferably greater than 4.5. The magnitude of the ratio is essential for obtaining the velocity required at the flow director for creating the desired turbulent movement of the fluid in the channel, and in that way increase the heat, moisture and/or mass transfer rate.

Suitably, at least one of the flow directors, comprises: a transition between the channel wall and the upstream portion; a transition between the upstream portion and the intermediate portion; a transition between the intermediate portion and the downstream portion; and a transition between the downstream portion and the channel wall. At least one of the transitions may be substantially direct.

According to a preferred embodiment, at least one of the transitions is curved with a predetermined radius. A curved transition directs the fluid smoothly and in that way decreases the pressure drop.

Preferably, a radius of said curved transition between said channel wall and said upstream portion and/or said transition between said upstream portion and said intermediate portion is between 0.1 times a height (h) of said flow director and 2 times said height (h) of said flow director. The curved transition between said channel wall and said upstream portion is in order to smoothly direct the laminar fluid flow in a direction transverse the channel, which will increase the fluid velocity since the cross-section is being reduced. The curved transition between said upstream portion and said intermediate portion 11 is in order to smoothly direct the fluid towards a direction parallel to one side of the channel after passing the upstream portion. Further, when coating is needed, a curve shaped surface is better, since the coating attachment to the underlying surface is increased and the coating through the whole channel may be more even. Less flash/burr is also created during the coating procedure. Flash/burr may be an accumulation of material at one spot, for example on a sharp edge. The accumulation, which may be thicker than the rest of the coating, may fall off when using it in high temperatures and through vibrations. Further, the flash increases the pressure drop substantially. A smoother surface do not only decrease the pressure drop, it also implies that the amount of precious metal needed decreases. Since the production cost is highly dependent on the needed amount of precious metal, the production cost is also reduced:

Advantageously, a radius of the curved transition between the intermediate portion and the downstream portion is 0.1*h-2.1*h, preferably 0.35*h-2.1*h, more preferably 0.35*h-1.1*h. A curved transition between the intermediate portion and the downstream portion decreases the pressure drop and consequently further improve the ratio of pressure drop to heat, moisture and/or mass transfer of fluids flowing through a channel system. The decrease of pressure drop results in that the flow rate of the fluid through the channel system increases and consequently, the power requirement of the system decreases. This together with the increased or equal heat, moisture and/or mass transfer rate results in a more efficient system. The radius improves the quality of the system also by guiding the fluid so that an eddy may be created, i.e. a controlled turbulent movement of the fluid, which is created due to the expanding cross-section. This turbulent movement is necessary to increase the heat, moisture and/or mass transfer rate. In addition, this smooth transition prevents creation of flash/burr during the coating procedure. Therefore, this transition has, in relation to the creation of flash/burr, same advantages as the transition between the intermediate portion and the downstream portion as is discussed above.

Suitably, a radius of the curved transition between the downstream portion and the channel wall is 0.2*h-2*h, preferably 0.5*h-1.5*h. The purpose of this radius is to prevent that a secondary eddy appears after the flow director. Such undesirable secondary eddy would increase the pressure drop without increasing heat, moisture and/or mass transfer. Hence, by avoiding such eddy the ratio of pressure drop to heat, moisture and/or mass transfer is increased. Thus, the pressure drop is further decreased, which in turn increases the efficiency of the channel system. In addition, this smooth transition prevents creation of flash/burr during the coating procedure. Therefore, this transition has, in relation to the creation of flash/burr, same advantages as the transition between the intermediate portion and the downstream portion as is discussed above.

Preferably, an intermediate portion of at least one of said flow directors comprises a flat portion, which is substantially parallel to said channel wall. The flat portion is utilised to direct the fluid in a direction parallel with the channel. This increases the velocity of the fluid in the direction parallel with the channel. The flat portion may also be needed in order to be able to manufacture the flow director. Advantageously, the flat portion has a length, in said fluid flow direction, of between 0 and 2 times a height (H) of said channel, that is 0-2.0*H, preferably between 0 and 2 times a height (h) of said flow director, that is 0-2.0*h, more preferably between 0 and 1 times a height (h) of said flow director, that is 0-1.0*h.

In a preferred embodiment, a flat part of the upstream portion of at least one of the flow directors has a first angle of inclination in relation to a plane of said channel wall from which said upstream portion deviates. This in order to direct the fluid towards a direction which is not parallel with the channel, so that a turbulent flow may develop in order to increase heat, moisture and/or mass transfer. Preferably, the first angle of inclination ($\alpha_1$) is 10°-60°, and preferably 30°-50°.

Preferably, a flat part of the downstream portion of at least one of the flow directors has a second angle of inclination in relation to the plane of the channel wall to which the downstream portion returns. This in order to create an eddy, i.e. a controlled turbulent movement of the fluid, which is created due to the divergent cross-section. This turbulent movement is necessary to increase the heat, moisture and/or mass transfer rate. The second angle of inclination ($\alpha_2$) is preferably 50°-90°, more preferably 60±10°. In a preferred embodiment according to the invention the intermediate portion of at least one of the flow directors remains on an inward side of the channel wall from which the upstream portion deviates.

Advantageously, the channel further comprises at least one mirror-inverted flow director to each of said first and second flow directors. Such a mirror-inverted flow director increases the heat, moisture and/or mass transfer rate in a whole system when several channels are arranged to each other.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

Other objectives, features and advantages of the present invention will appear from the following detailed disclosure, from the attached dependent claims as well as from the drawings.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements.

DESCRIPTION OF PREFERRED EMBODIMENTS

The present invention will be described in more detail below with reference to the accompanying schematic drawings, which for the purpose of illustration show a currently preferred embodiment.

Figure 1:
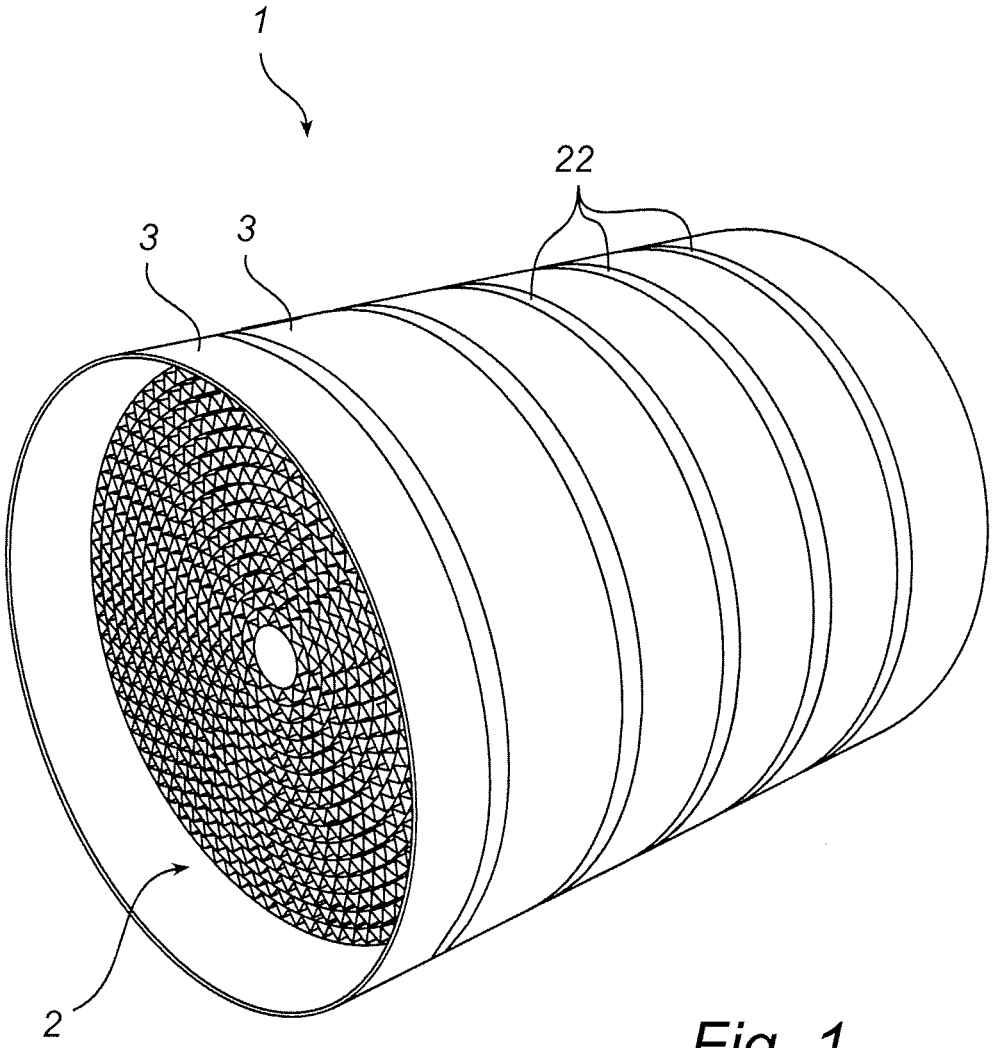
FIG. 1 is a perspective view of a roll according to the present invention.

FIG. 1 illustrates a roll 1 with a channel system 2 according to the present invention. The roll 1 may be used for example as a catalyst, in a heat exchanger, such as a heat wheel, a gas-cooled nuclear reactor, a gas turbine blade cooling, or any other suitable application.

A corrugated strip 20 together with at least one essentially flat strip 21, which forms channels 4, (see FIG. 8) are rolled up to a desired diameter to form a cylinder, which will constitute the actual core in the channel system 2 of the roll 1. As may be seen in FIG. 8 the essentially flat strip 21 comprises a number of grooves, and the wording essentially flat strip is here used for distinguishing this strip from the corrugated one. Indentations 22 in the corrugated strip 20 and the corresponding grooves in the essentially flat strip 21 (see FIG. 8) prevent telescoping of the roll that is formed, that is they prevent the different layers of strips 20 and 21 from being displaced relative to each other. In addition, a casing 3 (see FIG. 1) surrounds the channel system 2, holds the channel system 2 together and simplifies fastening of the channel system 2 to the adjacent construction.

Figure 8:
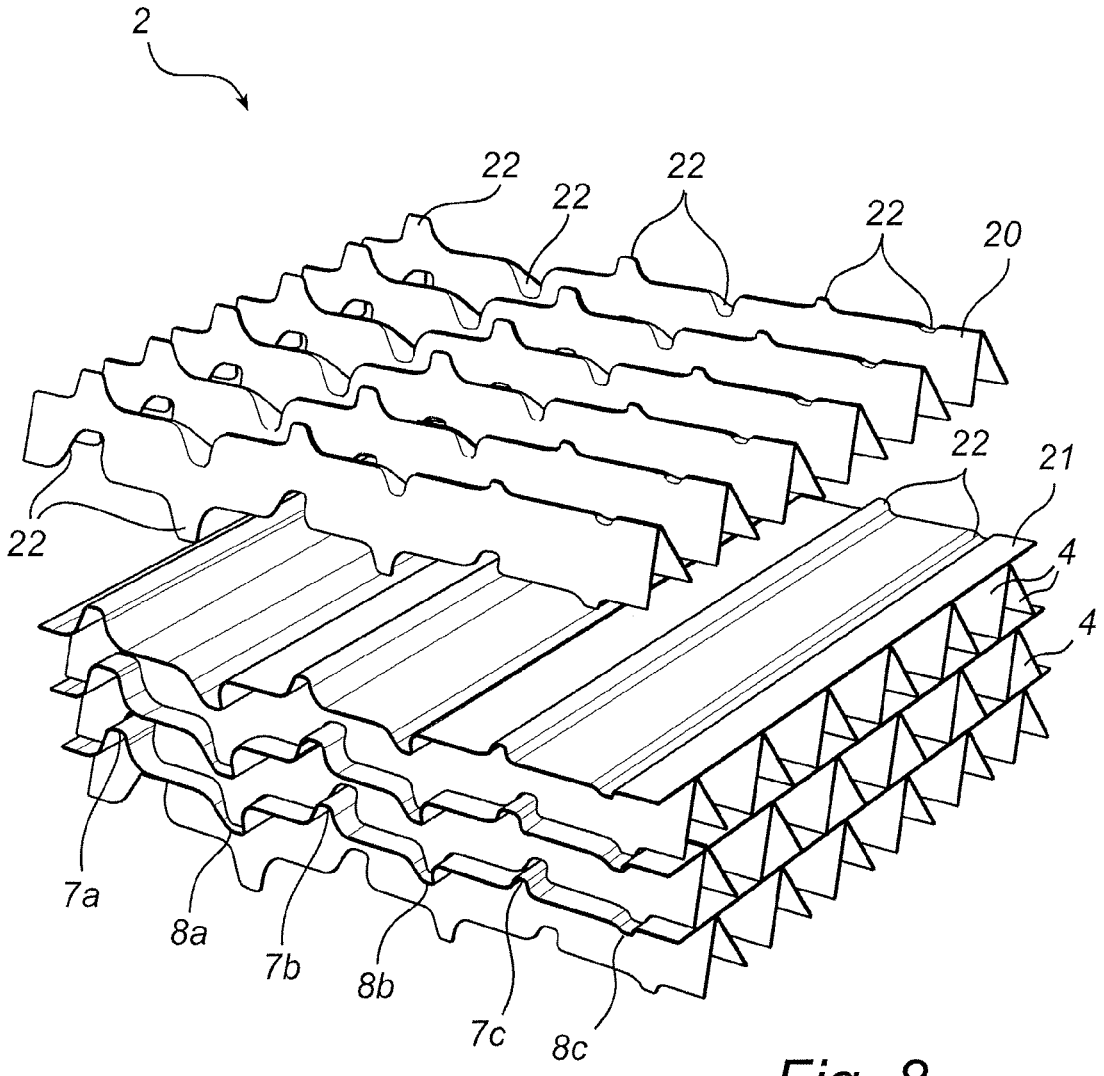
FIG. 8 illustrates a layer of channels in the longitudinal direction of the channels.

Alternatively, a number of corrugated strips 20 and flat strips 21 are arranged in layers by turns to form channels 4 (see FIG. 8). This arrangement is suitable for instance for plate heat exchangers.

Figure 2:
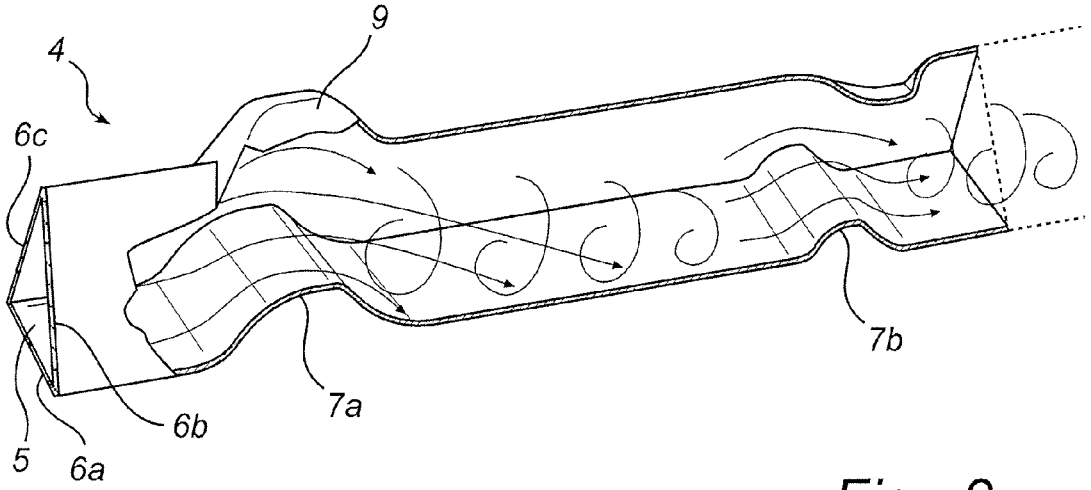
FIG. 2 is a perspective view of a part of a partially opened channel of a channel system according to the present invention.

FIG. 2 is a perspective view of a part of a partially opened channel 4 comprising two flow directors 7*a*, 7*b*. As only a part of the channel 4 is shown in the figure the outlet is excluded. The height of a first flow director 7*a* near the inlet 5 is greater than the height of a second flow director 7*b*. The invention is not limited to two flow directors; more than one of each type of flow directors 7*a*, 7*b* may be distributed along the whole length of the channel 4. In that case, the words "first" and "second" do not have to refer to flow directors disposed first and second in the fluid flow direction in relation to the inlet 5 of the channel 4. Instead, for all possible embodiments, "first" and "second" may refer to any flow directors disposed anywhere in the channel 4. Consequently, in all embodiments there may be one or several flow directors upstream of the flow director, which is denoted as the first. Alternatively, the flow directors may be located the other way around, that is the first flow director 7*a* may be positioned downstream of the second flow director 7*b*, in relation to the fluid flow direction.

The channel 4 is a channel of small dimension i.e. it is normally less than 4 mm in height. Preferably, the height H (see FIG. 3) of a channel 4 is from 1 mm to 3.5 mm. The channel 4 has an equilateral triangular cross-section with channel walls 6*a*, 6*b*, 6*c*, which may be less than 5 mm. However, the form of the cross-section is not limited to an equilateral triangular, it may take any shape suitable for this application. Thus, any top-shaped cross-section, with the top in any direction, is suitable. Consequently, also a trapezoidal cross-section is feasible. The number of channel walls 6*a-c* is not limited to three; it may be any suitable number. Further, in the fluid flow direction, the channel walls 6*a-c* encloses the channel 4, resulting in that the fluid may not flow from one channel 4 to another, for instance if several channels 4 are arranged next to each other. On the other hand, the invention is not limited to channels enclosed by channel walls 6*a-c*; a channel wall 6*a-c* may also partly enclose the channel 4, so that the fluid may flow from one channel 4 to another. The channels of the embodiments described hereafter have equilateral triangular cross-sections and channel heights H equal to 2.6 mm.

The length of the channel 4 may vary depending on the application. For instance, for catalysts the length of the channel 4 may be up to 150-200 mm, and for heat exchangers the length of the channel 4 may be 150-250 mm. However, the invention is not limited to these channel lengths. Also, it is possible to arrange an arbitrary number of channel systems 2 one after another, in order to form a system with a required length.

Further, the channel 4 may take any axial direction, that is the invention is not limited to horizontal channels 4.

The first flow director 7*a* is arranged on one channel wall 6*a* of the channel 4 so that the fluid flow (arrows) from the inlet 5 is directed towards the two other channel sides 6*b*, 6*c*. On the opposite side of the first flow director 7*a* is a bulge 9.

Precisely after passing the inlet 5, the fluid flow has inlet turbulence. The turbulence decreases as the fluid is flowing through the channel 4, which results in a laminar fluid flow having a constant velocity inside the channel 4. When the fluid approaches the first flow director 7*a* the velocity increases locally depending on the reduced cross-section. After passing the first flow director 7*a* an eddy is created, i.e. a controlled turbulent movement of the fluid, due to the expanding cross-section and the velocity of the fluid. The flow director 7*a* affects a major part of the fluid flowing through the channel 4, resulting in a mixing of the flow layers of the fluid. This turbulent movement is necessary to increase the heat, moisture and/or mass transfer rate. The turbulence decreases as the fluid flows towards the second flow director 7*b*, resulting in a laminar flow precisely upstream of the second flow director 7*b*. After passing the second flow director 7*b* an eddy is created, similarly to after the passage of the first flow director 7*a*. The smaller height of the second flow director 7*b* compared to the height of the first flow director 7*a*, results in a lower velocity at the second flow director 7*b* than at the first flow director 7*a* and in that less turbulence is created. Consequently, the pressure drop at the second flow director 7*b* is smaller compared to the pressure drop at the first flow director 7*a*.

Figure 3:
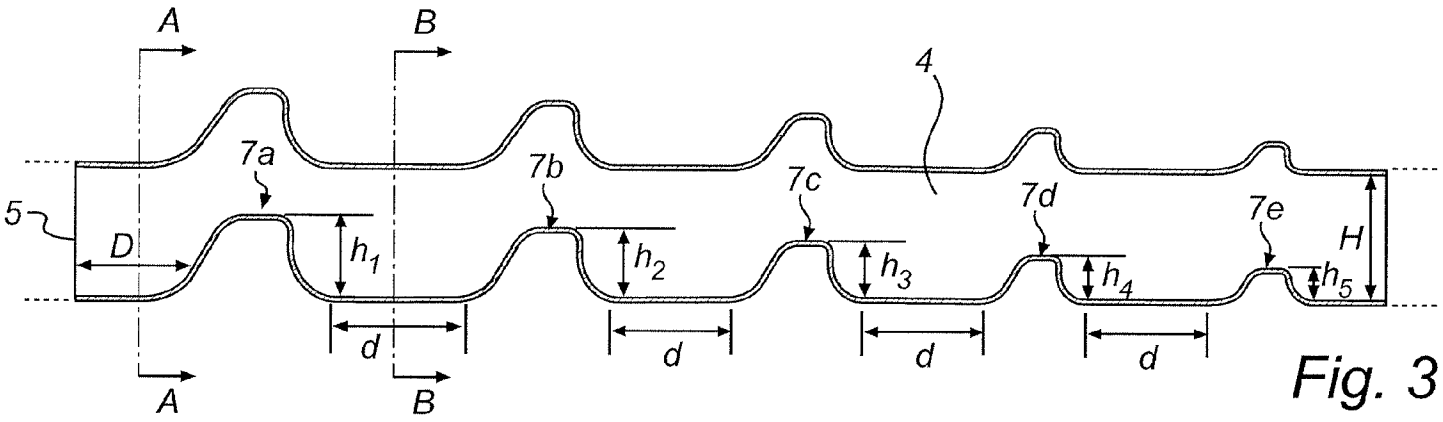
FIG. 3 is a longitudinal cross-section of a channel according to an embodiment of the present invention.
Figure 4:
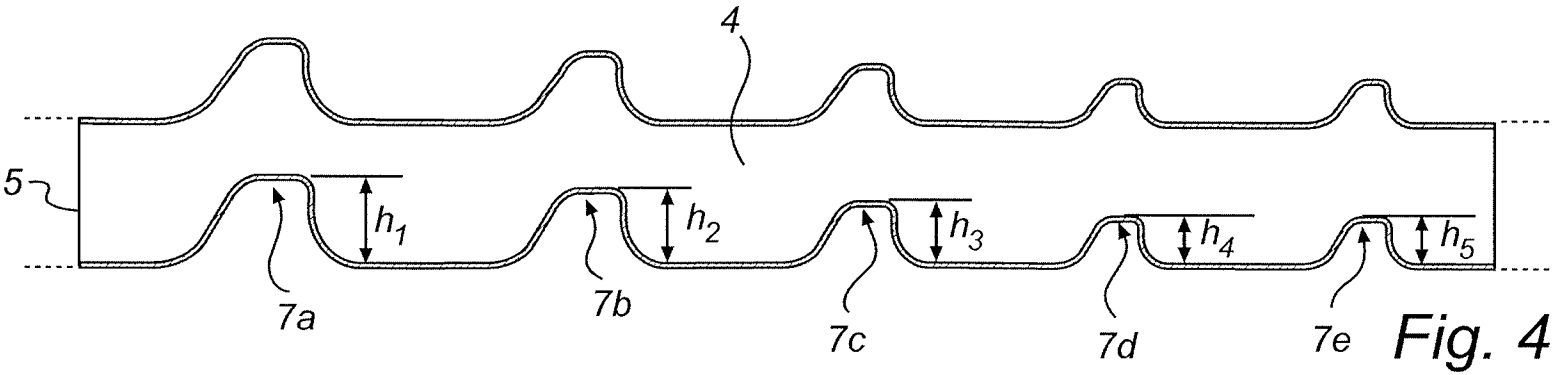
FIGS. 4-5 are longitudinal cross-sections of a channel according to alternative embodiments of the present invention.
Figure 5:
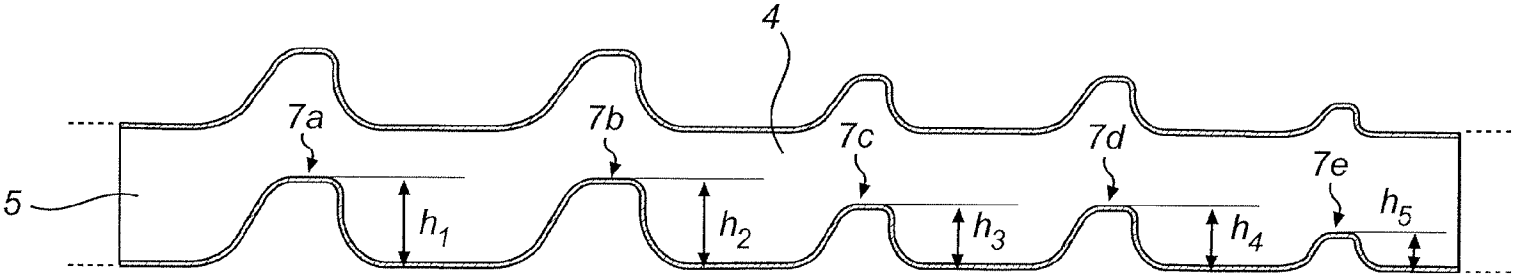

FIGS. 3-5 show longitudinal cross-sections of channels 4 comprising several flow directors 7*a-e*, which are arranged in a row after each other in the fluid flow direction. The flow directors 7*a-e* having different heights $h_1$-$h_5$, respectively, extend inwardly into the channel 4. Each flow director has an upstream portion, an intermediate portion, and a downstream portion. The fluid director 7*a* nearest the inlet 5 is arranged at a distance D from the inlet 5, which distance may be adjusted depending on operating conditions. The distance d between two adjacent low directors 7*a-e*, that is there are no additional flow directors between the two flow directors 7*a-e*, is large enough to maximally utilise the turbulent movement created after passing the first flow director 7*a* and to allow the fluid to establish a laminar flow having a direction which is parallel to the channel walls 6*a-c*. The invention is not limited to flow directors spaced with equal distances d from each other. In some applications it may be suitable with different distances between each pair of flow directors.

Figure 3B:
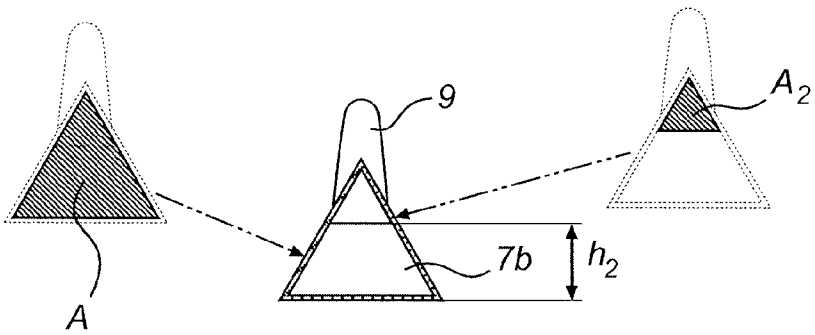
FIG. 3*b* is a cross-section of the channel in FIG. 2 according to the embodiment in FIG. 3 at B-B.
Figure 3A:
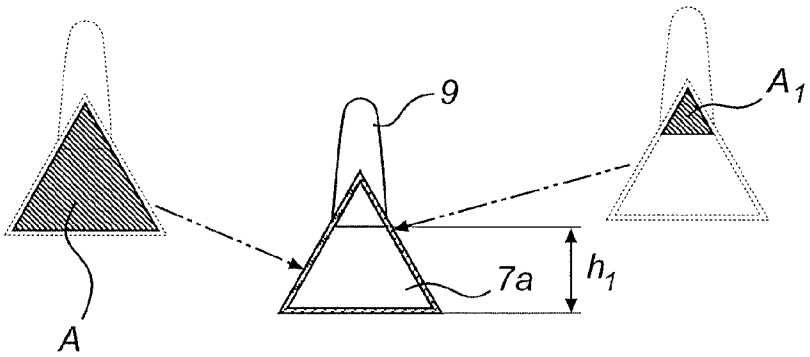
FIG. 3*a* is a cross-section of the channel in FIG. 2 according to the embodiment in FIG. 3 at A-A.

By varying the heights of the flow directors 7*a-e* the cross-section areas of the channel 4 at respective flow director 7*a-e* may be varied. This is illustrated in FIGS. 3*a* and 3*b*. FIG. 3*a* shows the cross-section of the channel 4 in FIG. 3 at A-A. The cross-section area A of the channel 4 is defined as the cross-section at the inlet 5 of the channel 4. The cross-section area $A_1$ of the channel 4 at the first flow director 7*a* is defined as the cross-section area at the intermediate portion 11 (see FIG. 7) at height $h_1$ (see FIG. 3*a*). FIG. 3*b* shows the cross-section of the channel in FIG. 3 at B-B. The cross-section area $A_2$ of the channel 4 at the second flow director 7*b* is defined as the cross-section area at the intermediate portion 11 (see FIG. 7) of the second flow director 7*b* at height $h_2$ (see FIG. 3*b*). As is seen in the FIGS. 3*a* and 3*b*, a smaller height of the flow director gives a larger cross-section area. The cross-section areas, $A_3$-$A_5$, of the channel 4 at the flow directors 7*c-e* downstream of said two flow directors 7*a, b* vary correspondingly with the respective height, $h_3$-$h_5$, of the flow directors 7*c-e*.

The ratio of the second cross-section area, $A_2$, at a second flow director 7*b*, arranged next to and downstream of a first flow director 7*a*, which is arranged closest to the inlet 5, to the first cross-section area $A_1$, that is $A_2/A_1$, is 1.2-2.5, and preferably 1.2-2.0. A ratio of the second cross-section area, $A_2$-$A_5$, at a flow director 7*b-e* downstream of, in fluid flow direction, and directly subsequent to any other flow director 7*a-d*, to the first cross-section area $A_1$-$A_4$, that is $A_2/A_1$, $A_3/A_1$, $A_4/A_1$, $A_5/A_1$, $A_3/A_2$, $A_4/A_2$, $A_5/A_2$, $A_4/A_3$, $A_5/A_3$, or $A_5/A_4$, is 1.2-2.5, and preferably 1.2-2.0. Further, the ratio of the cross-section area $A_5$ at the flow director 7*e*, located closest to the outlet of the channel, to said first cross-section area $A_1$ at the first flow director, located closest to the inlet 5 of the channel 4, that is $A_5/A_1$, is 2.0-4.0. By varying the cross-section area of the channel 4 at the flow directors 7*a-e* the relation of the total conversion rate to the total pressure drop of the whole channel may be improved. That is, the pressure drop may be decreased, while the conversion rate is maintained or improved. Preferably, the cross-section area is varied by varying the height, $h_1$-$h_5$, of the flow directors 7*a-e*. Even though the embodiments in the FIGS. 3-5 have all the above-mentioned features, the invention is not limited to having all above-mentioned features; an embodiment may have only one or a couple of the features mentioned above.

Further, FIG. 3 shows a part of or a channel comprising five flow directors 7*a-e*, wherein the heights of the flow directors 7*a-e*, $h_1$-$h_5$, decreases gradually. For instance for a channel of height H equal to 2.6 mm, the height $h_1$ is 1.4 mm, $h_2$ is 1.2 mm, $h_3$ is 1.0 mm, $h_4$ is 0.8 mm, and $h_5$ is 0.6 mm. Thus, the cross-section area of the channel 4 at the flow directors 7*a-e* increases in fluid flow direction as follows: the cross-section area $A_1$ at the first flow director 7*a* is 0.63 $mm^2$, the cross-section area $A_2$ at the second flow director 7*b* is 0.88 $mm^2$, the cross-section area $A_3$ at the third flow director 7*c* is 1.15 $mm^2$, the cross-section area $A_4$ at the fourth flow director 7*d* is 1.43 $mm^2$, and the cross-section area $A_5$ at the fifth flow director 7*e* is 1.76 $mm^2$. The heights are decreasing in order to achieve the above-mentioned reduced total pressure drop in relation to the total conversion of the whole channel 4 as compared to prior art.

FIG. 4 shows a or a part of a channel comprising five flow directors 7*a-e*, wherein the heights, $h_1$-$h_4$, of the first four flow directors 7*a-d* from the inlet 5, in fluid flow direction, decreases gradually and the fifth flow director 7*e* from the inlet 5 has a height $h_5$ equal to the height of the fourth flow director 7*d*. In an embodiment having a channel of height H equal to 2.6 mm, the height $h_1$ is 1.4 mm, $h_2$ is 1.2 mm, $h_3$ is 1.0 mm, $h_4$ is 0.8 mm, and $h_5$ is 0.8 mm. Thus, the cross-section area of the channel 4 at the flow directors 7*a-e* increases in fluid flow direction as follows: the cross-section area $A_1$ at the first flow director 7*a* is 0.63 $mm^2$, the cross-section area $A_2$ at the second flow director 7*b* is 0.88 $mm^2$, the cross-section area $A_3$ at the third flow director 7*c* is 1.15 $mm^2$, and each cross-section area $A_4$, $A_5$ at respective fourth and fifth flow director 7*d, e* is 1.43 $mm^2$. The heights are decreasing in order to achieve the above-mentioned reduced total pressure drop in relation to the total conversion rate of the whole channel 4 as compared to prior art.

FIG. 5 shows a part of or a channel comprising five flow directors 7*a-e*, wherein the flow directors 7*a-e* are arranged in groups of two flow directors. The flow directors within each group have equal heights, and the height of each group of flow directors decreases, in fluid flow direction from the inlet 5, gradually. That is, the height $h_2$ of the second flow director 7*b* from the inlet, in fluid flow direction, is equal to the height $h_1$ of the first flow director 7*a*, the height $h_3$ of the third flow director 7*c* is smaller than the height $h_2$ of the second flow director 7*b*, the height $h_4$ of the fourth flow director 7*d* is equal to the height $h_3$ of the third flow director 7*c*, and the height $h_5$ of the fifth flow director 7*e* is smaller than the height $h_4$ of the fourth flow director 7*d*. For instance, for a channel of height H, which equals 2.6 mm, the height $h_1$ is 1.4 mm, $h_2$ is 1.4 mm, $h_3$ is 1.2 mm, $h_4$ is 1.2 mm, and $h_5$ is 1.0 mm. Thus, the cross-section area of the channel 4 at the flow directors 7*a-e* increases in fluid flow direction as follows: respective cross-section areas $A_1$, $A_2$ at the first and second flow director 7*a, b*, respectively, is 0.63 $mm^2$, respective cross-section area $A_3$, $A_4$ at the third and fourth flow director 7*c, d*, respectively is 0.88 $mm^2$, and the cross-section area $A_5$ at the fifth flow director 7*e* is 1.15 $mm^2$. The heights are decreasing in order to achieve the above-mentioned reduced total pressure drop in relation to the total conversion rate of the whole channel 4 as compared to prior art. However, the invention is not limited to groups of two flow directors; groups of any arbitrary number of flow directors may be suitable.

However, the invention is not limited to gradually increasing cross-section areas of the channel 4 at the flow-directors 7*a-e*. Instead, the flow directors resulting in different cross-section areas of the channel 4 may be positioned in an arbitrary order in the channel, and there may be a number of flow directors resulting in equal cross-section areas of the channel 4. For instance, a first flow director resulting in a cross-section area of the channel 4, which is smaller than a second cross-section area of the channel 4 at a second flow director, may be positioned in-between two such second flow directors each resulting in the second cross-section area of the channel 4. Also, the number of flow directors is not limited to five; the number of flow directors may be arbitrary and differ for different applications. For instance, the channel 4 may comprise three flow directors disposed near the inlet 5 of the channel 4, so that there are no flow directors at an end portion of the channel 4 near the outlet. Alternatively, the distance D between the inlet 5 and the first flow director may be relatively large, so that there may be a number of flow directors disposed at the end of the channel 4 near the outlet and none near the inlet 5. Also, there may be additional flow directors at which the channel 4 has respective cross-section areas, which are different from the cross-section areas at the flow directors in the examples above. Alternatively, the cross-section area of the channel 4 may be varied by varying the height of the channel, the width of the channel or the geometrical form of the channel. The invention is not limited to above-mentioned combinations of flow-directors; instead all suitable combinations defined according to the appended claims are possible.

Figure 6:
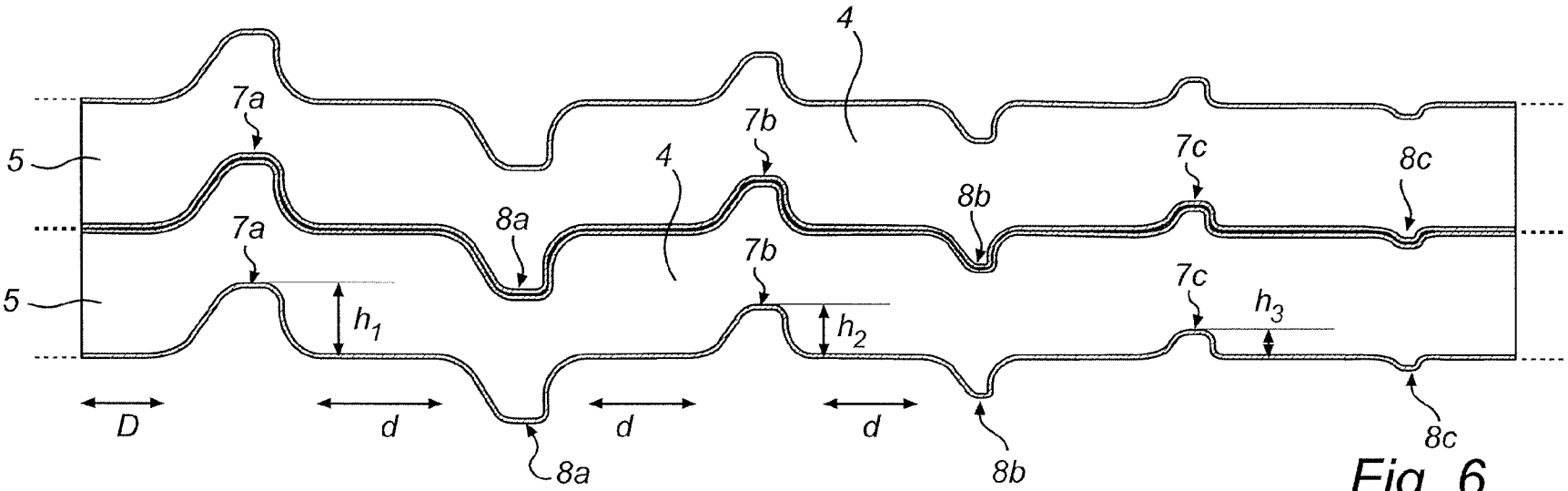
FIG. 6 is a cross-section of two channels, according to an embodiment of the invention, arranged on top of each other.

FIG. 6 shows two channels 4 arranged on each other comprising a number of, in relation to the flow directors 7*a-c*, mirror-inverted flow directors 8*a-c*. If only flow directors, which extend into the channel, are used, only half of the channels will have flow directors when they are rolled up together or arranged upon each other as in FIGS. 6 and 8. In order to further increase the heat, moisture and/or mass transfer it is suitable that the channels are provided with such mirror-inverted flow directors 8*a-c*, so that all channels are provided with flow directors. The mirror-inverted flow directors 8*a-c* to the flow directors 7*a-c* are each positioned at a predetermined distance d from respective flow director 7*a-c*. The distance d should be so large that the turbulent movement created after passing the flow director 7*a-c* may be maximally utilised and that the fluid may take the direction of the channel 4, i.e. parallel to the channel walls 6*a-c*. The fluid that is getting closer to the mirror-inverted 8*a-c* flow director gets a large expansion area and the velocity decreases locally. Alternatively, the distance between the two-types of flow directors may be varied. Preferably, the mirror-inverted flow directors 8*a-c* are associated with each of said flow directors 7*a-c*. In such a case, each mirror-inverted flow director 8*a-c* is positioned side by side with said associated flow director 7*a-c*, respectively.

In FIG. 6 the heights, $h_1$-$h_3$, of the flow directors 7*a-c*, in fluid flow direction, decreases gradually. In an embodiment having a channel height equal to 2.6 mm, the height $h_1$ is 1.4 mm, $h_2$ is 1.2 mm, and $h_3$ is 1.0 mm. Thus, the cross-section area of the channel 4 at the flow directors 7*a-c* increases in fluid flow direction as follows: the cross-section area $A_1$ at the first flow director 7*a* is 0.63 $mm^2$, the cross-section area $A_2$ at the second flow director 7*b* is 0.88 $mm^2$, and the cross-section area $A_3$ at the third flow director 7*c* is 1.15 $mm^2$.

Alternatively, the flow directors 7*a-c* and the mirror-inverted flow directors 8*a-c* may be positioned in groups of two or several flow directors of each type. That is, in the fluid flow direction, the first and the second flow 0directors may be regular flow directors 7*a-c* and the third and the fourth flow directors may be mirror-inverted flow directors 8*a-c*. Still another alternative is, to position different types of flow directors 7*a-c*, 8*a-c* in an arbitrary order in the channel.

Figure 7:
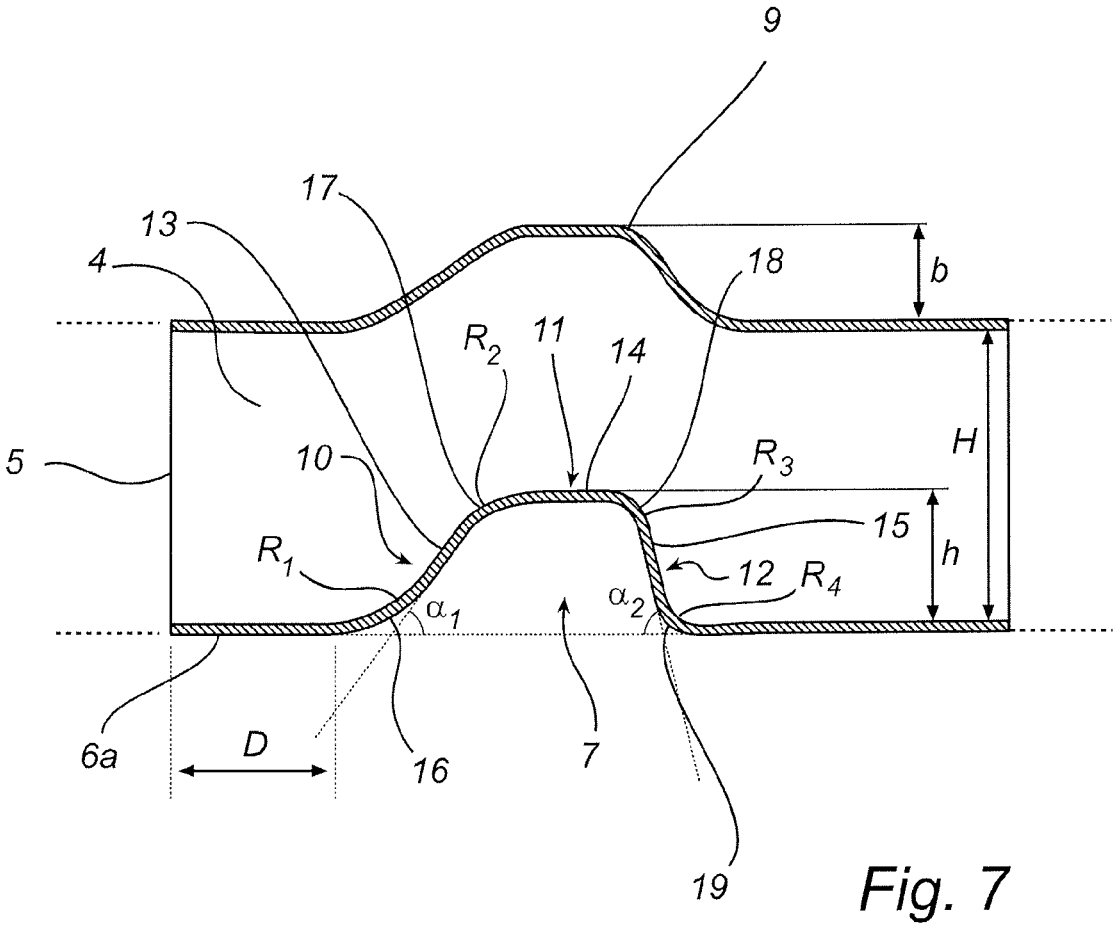
FIG. 7 shows in detail a preferred embodiment of a flow director.

FIG. 7 shows in detail a possible embodiment of a flow director 7 having an upstream portion 10, an intermediate portion 11, and a downstream portion 12. All flow directors of the channel 4 have preferably the geometrical shape of the flow director 7 in FIG. 7. However, within the scope of the invention only one or a few flow directors may have such a shape.

The upstream portion 10 comprises a flat part 13, which deviates, in the fluid flow direction, at a predetermined first angle of inclination $\alpha_1$ in relation to the plane of the channel wall 6*a*. The first angle of inclination $\alpha_1$ is defined as the angle between the plane of the channel wall 6*a* and an extension of the flat part 13 to the plane of the channel wall 6*a*, which angle is located downstream of the intersection point of the extension of the flat part 13 and the plane of the channel wall 6*a*. The first angle of inclination $\alpha_1$ is also defined as the angle $\alpha_1$ in FIG. 7. Further, the first angle of inclination $\alpha_1$, is 10°-60°, and preferably 30°-50°. The inclination of the upstream portion 10 increases the velocity of the fluid and directs the fluid towards the other surfaces, so that a controlled turbulent movement is initiated in order to increase the heat, moisture and/or mass transfer.

The intermediate portion 11 is arranged between the upstream portion 10 and the downstream portion 12. The intermediate portion 11 remains on the inward side of the channel wall 6*a* from which the upstream portion 10 extends. The intermediate portion 11 comprises a flat part 14, which is parallel to one channel wall 6*a* of the channel 4 and small relative to the lengths of the upstream and downstream portions 10, 12. The maximum height h of the flow director, in relation to the channel wall 6*a* from which the flow director 7 extends, is at the flat part 14 of the intermediate portion 11. For the embodiments with several flow directors the height of the flow director h may refer to the height $h_1$-$h_5$ of any of the flow directors. The flat part 14 may be there for production reasons, however it also helps to direct the fluid to flow in the direction of the channel 4, i.e. parallel to the channel walls 6*a-c* of the channel 4, after being directed towards the opposite walls 6*b*, 6*c* by the upstream portion. The flat part may have a length in the fluid flow direction of between 0 and 2.0 times a height H of said channel, that is 0-2.0*H, preferably between 0 and 2 times a height h of said flow director, that is 0-2.0*h, more preferably between 0 and 1 times a height h of said flow director, that is 0-1.0*h. Instead of being parallel to the channel wall 6*a* from which the upstream portion 10 extends, the flat part 14 of the intermediate portion 11 may have an inclination in relation to the channel wall 6*a* from which the upstream portion 10 extends. The inclination may be, in the fluid flow direction, both inwardly into the channel 4 or towards the channel wall 6*a*. In another embodiment the intermediate portion 11 may have a slightly curved shape, for instance convex.

Suitably, the downstream portion 12 of the flow director 7 comprises a flat part 15, which returns, in fluid flow direction, to the channel wall 6*a* with a predetermined second angle of inclination $\alpha_2$ in relation to the plane of the channel wall 6*a*. The second angle of inclination $\alpha_2$ is defined as the angle between the plane of the channel wall 6*a* and an extension of the flat part 15 to the plane of the channel wall 6*a*, which angle is located upstream of the intersection point of the extension of the flat part 15 and the plane of the channel wall 6*a*. The second angle of inclination $\alpha_2$ is also defined as the angle $\alpha_2$ in FIG. 7. Further, the second angle of inclination $\alpha_2$, is 50°-90°, and preferably 60±10°. The flat part 15 allows the fluid to create a controlled turbulent movement, due to the expanding cross-section, which optimises the ratio between heat, moisture and/or mass transfer and pressure drop.

The flow director 7 comprises a transition 16 between said channel wall 6*a* and said upstream portion 10, a transition 17 between said upstream portion 10 and said intermediate portion, a transition 18 between said intermediate portion 11 and said downstream portion 12, and a transition 19 between said downstream portion 12 and said channel wall 6*a*. Each transition 16-19 may be curved or direct, and one flow director 7 may comprise both curved and direct transitions.

FIG. 7 shows a curved transition 17 between the upstream portion 10 and the intermediate portion 11 having a radius $R_2$, which is 0.1-2 times the height of the flow director 7, i.e. 0.1*h-2*h. This, in order to smoothly direct the fluid flow towards a direction parallel to one side of the channel 4 after passing the upstream portion 10. Suitably, a radius $R_3$ of a curved transition 18 between the intermediate portion 11 and the downstream portion 12, is 0.1-2.1 times the height of the flow director 7, i.e. 0.1*h-2.1*h, preferably 0.35-2.1 times the height of the flow director 7, i.e. 0.35*h-2.1*h, and more preferably 0.35-1.1 times the height of the flow director 7, i.e. 0.35*h-1.1*h. This radius directs a major part of the fluid towards the channel wall 6*a* creating an eddy, i.e. a controlled turbulent movement of the fluid, which is created due to the expanding cross-section. This turbulent movement is necessary to increase the heat, moisture and/or mass transfer rate. Alternatively, the radius $R_2$ of a curved transition between 17 the upstream portion 10 and the intermediate portion 11 may be equal to the radius $R_3$ of a curved transition 18 between said intermediate portion 11 and said downstream portion 12. That is, 0.1-2.1 times the height of the flow director 7, i.e. 0.1*h-2.1*h, preferably 0.35-2.1 times the height of the flow director 7, i.e. 0.35*h-2.1*h, and more preferably 0.35-1.1 times the height of the flow director 7, i.e. 0.35*h-1.1*h. Equal radii are advantageous in some applications in which the fluid may flow also in a direction opposite to the aforementioned fluid flow direction.

The radius $R_1$ of a curved transition 16 between the channel wall 6*a* of the channel 4 and the upstream portion 10 is 0.1-2 times the height h of the flow director 7, i.e. 0.1*h-2*h. Preferably, a radius $R_4$ of a curved transition 19 between the downstream portion 12 and the channel wall 6*a* of the channel 4 is 0.2-2 times the height of the flow director 7, i.e. 0.2*h-2*h, and preferably 0.5-1.5 times the height of the flow director 7, i.e. 0.5*h-1.5*h. The flat part 15 of the downstream portion 12 may be short, so that the transition 19 may have a large radius. The radius $R_4$ of the transition 19 between the downstream portion 12 and the channel wall 6*a* of the channel 4, reduces formation of a secondary eddy, which otherwise may increase the pressure drop.

The smooth transitions 16-19 results in a smoother fluid flow over the flow director 7 and at the same time the transitions 16-19 direct the fluid in a certain direction. The smooth transitions also decrease the pressure drop, since the pressure drop is established by the friction between the fluid and the walls of the channel.

Above the flow director 7 a bulge 9 is arranged. Preferably, the height b of the bulge 9 is less than the height h of the flow director 7. This reduces unnecessary turbulence in the bulge 9. Further preferably, the bulge 9 has a shape that fits well in the corresponding bulge 9, which is defined by the flow director on the underside of a second channel 4 (see FIG. 6). The height of the bulge 9 is preferably so high that a stable assembly is obtained when arranging channels in layers, this in order to prevent telescoping. Here, telescoping refers to undesired movement of the channel layers in relation to each other. The invention is not limited to having one bulge at each flow director 7. Instead, there may for instance be one bulge, in fluid flow direction, at the first flow director 7 and one at the last flow director 7.

Referring again to FIG. 3, in order to create the desired turbulent movement, a certain velocity $v_1$ of the fluid, at the intermediate portion 11 (see FIG. 7) of the first flow director 7*a* is necessary. The velocity $v_1$ depends on the cross-section area $A_1$ of the channel at the intermediate portion 11 (see FIG. 7) of the first flow director 7*a*, the cross-section area A of the channel 4 and the velocity, v, in the portions of the channel with the cross-section area A, for instance at the inlet 5 of the channel. The ratio of area A to area $A_1$ is greater than 2.0, preferably greater than 3.0, and more preferably greater than 4.5.

FIG. 8 illustrates a layer with channels 4 in a channel system 2 in the longitudinal direction of the channels. A corrugated strip 20 is preferably used, in which flow directors 7*a-c*, 8*a-c* are pressed from one side so as to form both indentations 22 at the fold edges and pressed-out portions at the inner fold edges. The indentations 22 are here the same as the flow directors 7*a-c*, 8*a-c* explained above. In FIG. 8, a substantially flat strip 21 is used, which is also formed with indentations 22 corresponding to those in the corrugated strip 20. The flat strip 21 and the corrugated strip 20 are pressed one on top of the other so that the indentations 22 in the flat strip 21 fits into the indentations 22 in the corrugated strip 20.

All channels 4 with a tip of the cross-sectional triangle pointing downward and all channels 4 with a tip of the cross-sectional triangle pointing upward are provided with indentations/pressed-out portions, resulting in that all channels are provided with flow directors, which additionally increase the heat moisture and/or mass transfer. For providing all channels with flow directors, indentations/pressed-out portions are made from both sides, so that the base of the triangle, that is the cross-section of the channel, is pressed inward, thereby achieving a reduction of the cross-sectional area. The indentations/pressed-out portions of the channels with the tip of the triangular cross-section pointing outwardly and inwardly, respectively, are offset relative to each other along the channels, and preferably equidistantly spaced from each other. In a cross-section of one and the same channel at different points along the same, there are thus indentations of the base of the triangle/pressed-out portion of the tip of the triangle and indentations of the tip of the triangle/pressed-out portion of the base of the triangle. It is mainly a reduction of the cross-sectional area that helps to generate turbulence. This means that the portions where the base is pressed inward toward the centre of the channel generate most of the turbulence since this is where the cross-sectional area is reduced. At the portions where the tip of the triangle is pressed inward towards the centre of the channel and the base is pressed outward, there is an increase of the cross-sectional area instead.

Although the invention above has been described in connection with preferred embodiments of the invention, it will be evident for a person skilled in the art that several modifications are conceivable without departing from the invention as defined by the following claims. For example, as described above, the corrugated strip can be corrugated in other ways so that other channel profiles are obtained. If the configuration of the flow directors does not constitute an obstacle to telescoping, for example if the angles of the upstream and downstream portions are small relative to the longitudinal direction of the channel, it is possible to make a special indentation/pressed-out portion with slightly less acute angles relative to the longitudinal direction of the channels. These telescoping obstacles should then be small, that is small relative to the cross-section of the channels, compared with the flow directors in order to minimise the pressure drop. These telescoping obstacles may, of course, also supplement flow directors, which already serve as telescoping obstacles.

The invention claimed is:

1. Channel system for improving the relation between pressure drop and heat, moisture and/or mass transfer of fluids flowing through said system, said channel system comprising:

at least one channel having a height H between 1.0 mm and 3.5 mm and a triangular cross-section A, said channel including at least a first and a second flow director extending in a fluid flow direction and transversely to said channel, each flow director having a height of at least 0.35*H, said channel having a first cross-section area A1 at the first flow director and a second cross-section area $A_2$ at the second flow director, said first cross-section area $A_1$ being smaller than said second cross-section area $A_2$, each of said flow directors comprising, an upstream portion deviating, in said fluid flow direction, from a channel wall of said channel inwardly into said channel, a downstream portion returning, in said fluid flow direction, towards said channel wall, and an intermediate portion located between said upstream and downstream portions, said intermediate portion including a flat part which is parallel to said channel wall, at least one of said flow directors comprising, a first transition between said channel wall and said upstream portion, and a second transition between said downstream portion and said channel wall, said first and second transitions being curved with a desired radius, the desired radius of the first transition being greater than the desired radius of the second transition, wherein, a flat part of said upstream portion of at least one of said flow directors has a first angle of inclination in relation to a plane of said channel wall from which said upstream portion deviates, a flat part of said downstream portion of at least one of said flow directors has a second angle of inclination in relation to said plane of said channel wall to which said downstream portion returns, and the second angle of inclination is greater than the first angle of inclination; and a flat strip including a plurality of indentations, wherein the at least one channel is a plurality of channels with respective first and second flow directors, the plurality of channels being arranged on the flat strip such that the plurality of indentations fit with the respective first and second flow directors.

2. Channel system according to claim 1, wherein said first and second cross-section areas $A_1$, $A_2$ are located at respective intermediate portions of said first and second flow directors.

3. Channel system according to claim 1, wherein said first flow director is located, in the fluid flow direction, upstream of said second flow director.

4. Channel system according to claim 1, wherein said first flow director is arranged closest to an inlet of said channel in relation to said second flow director.

5. Channel system according to claim 1, wherein said first and second flow directors are directly subsequent in said fluid flow direction.

6. Channel system according to claim 5, wherein
a ratio of said second cross-section area $A_2$ to said first cross-section area $A_1$, that is $A_2/A_1$, is $1.2 \leq (A_2/A_1) \leq 2.5$.

7. Channel system according to claim 4, wherein
a ratio of said second cross-section area $A_2$ at a second flow director located closest to the outlet of the channel in relation to said first cross-section area $A_1$ at the first flow director, that is $A_2/A_1$, is 2.0 s $(A_2/A_1) \leq 4.0$.

8. Channel system according to claim 1, wherein
a width of said cross-section of said channel is decreasing in one direction in the plane of said cross-section.

9. Channel system according to claim 3, wherein
a ratio of said cross-section area A of said channel to said first cross-section area $A_1$ at said first flow director, that is $A/A_1$, is greater than 2.0.

10. Channel system according to claim 1, wherein at least one of said flow directors, comprises:
a third transition between said upstream portion and said intermediate portion; and
a fourth transition between said intermediate portion and said downstream portion.

11. Channel system according to claim 10, wherein at least one of said third and fourth transitions is direct.

12. Channel system according to claim 10, wherein at least one of said third and fourth transitions is curved with a predetermined radius.

13. Channel system according to claim 12, wherein
a radius ($r_1$) of said curved first transition between said channel wall and said upstream portion and/or said third transition between said upstream portion and said intermediate portion is between 0.1 times a height (h) of said at least one of the flow directors and 2 times said height (h) of said flow director ($0.1\ h \leq r_1 \leq 2\ h$).

14. Channel system according to claim 13, wherein
a radius ($r_2$) of said curved fourth transition between said intermediate portion and said downstream portion is $0.1\ h \leq r_2 \leq 2.1\ h$.

15. Channel system according to claim 13, wherein
a radius ($r_3$) of said curved second transition between said downstream portion and said channel wall is $0.2\ h \leq r_3 \leq 2\ h$.

16. Channel system according to claim 1, wherein said flat part has a length, in said fluid flow direction, of between at least one of 0 and 2 times a height of said channel, and between 0 and 2 times a height of said flow director.

17. Channel system according to claim 1, wherein said first angle of inclination is 10° to 60°.

18. Channel system according to claim 1, wherein said second angle of inclination is 50° to 90°.

19. Channel system according to claim 1, wherein
said intermediate portion of at least one of said flow directors remains on an inward side of said channel wall from which said upstream portion deviates.

20. Channel system according to claim 1, wherein
the channel further comprises a mirror-inverted flow director for each of said first and second flow directors, a height of the first flow director and the second flow director decreasing in the direction of the fluid flow, each mirror-inverted flow director being offset from each of the first and second flow directors and projecting from the channel wall in a direction opposite to a direction in which the first and second flow directors project from the channel wall, each mirror-inverted flow director having the same dimensions as the first and second flow directors.

21. A combination catalytic converter and heat exchanger system, comprising:
the channel system of claim 1.

22. Channel system according to claim 1, wherein the channel further comprises a bulge above and aligned with the at least one flow director, a height of the bulge being less than the height of the at least one flow director.

23. Channel system according to claim 22, wherein
the channel further comprises a mirror-inverted flow director for each of said first and second flow directors, a height of the first flow director and the second flow director decreasing in the direction of the fluid flow, each mirror-inverted flow director being offset from each of the first and second flow directors and projecting from the channel wall in a direction opposite to a direction in which the first and second flow directors project from the channel wall, each mirror-inverted flow director having substantially the same dimensions as the first and second flow directors.

24. Channel system according to claim 1, wherein the first flow director creates an eddy that begins at the first flow director and dissipates into a laminar flow at a location beyond the first flow director but before the second flow director.

25. Channel system according to claim 1, further comprising:
a corrugated strip which together with said flat strip forms said plurality of channels.

26. Channel system according to claim 25, wherein the corrugated strip includes upwardly pointing tips and downwardly pointing tips whereby a first sub-set of the plurality of channels have the triangular cross-section shape with the upwardly pointing tips, and a second sub-set of the plurality of channels have the triangular cross-section shape with the downwardly pointing tips.

27. Channel system according to claim 25, wherein said corrugated strip includes a plurality of indentations corresponding to the plurality of indentations in the flat strip.

28. Channel system according to claim 27, wherein the flat strip and the corrugated strip are pressed one on top of another such that the plurality of indentations in the flat strip fits into the plurality of indentations in the corrugated strip.

29. Channel system according to claim 28, wherein the plurality of indentations of the flat strip and the corrugated strip, respectively, are arranged such that they prevent the flat strip and the corrugated strip from being displaced relative each other.

30. Channel system according to claim 26, wherein the flat strip comprises two opposing sides, and the corrugated strip comprises two opposing sides, and wherein both opposing sides of at least one of the flat strip and the corrugated strip, respectively, are provided with pressed out portions to form the respective plurality of indentations.

31. Channel system according to claim 30, wherein the pressed-out portions point in a direction pointing outwardly of a specific channel, and in a direction pointing inwardly to the specific channel, and wherein the outwardly pointing indentations are offset relative to the inwardly pointing indentations.

32. Channel system according to any one of claim 25, wherein said flat strip and said corrugated strip are rolled up to form a cylinder or a roll.

33. Channel system according to claim 32, further comprising a casing which surrounds the plurality of channels, and holds the plurality of channels together.

* * * * *